US009109607B2

(12) United States Patent
Takeshita et al.

(10) Patent No.: US 9,109,607 B2
(45) Date of Patent: Aug. 18, 2015

(54) BLOWER FAN

(75) Inventors: Hidenobu Takeshita, Kyoto (JP); Tomotsugu Sugiyama, Kyoto (JP)

(73) Assignee: Nidec Corporation, Kyoto (JP)

( * ) Notice: Subject to any disclaimer, the term of this patent is extended or adjusted under 35 U.S.C. 154(b) by 870 days.

(21) Appl. No.: 13/277,239

(22) Filed: Oct. 20, 2011

(65) Prior Publication Data

US 2012/0269665 A1 Oct. 25, 2012

(30) Foreign Application Priority Data

Oct. 22, 2010 (JP) ..... 2010-237230

(51) Int. Cl.

| | |
|---|---|
| ***F04D 19/00*** | (2006.01) |
| ***F04D 25/00*** | (2006.01) |
| ***F04D 25/06*** | (2006.01) |
| ***F04D 29/053*** | (2006.01) |
| *F04D 29/057* | (2006.01) |

(52) U.S. Cl.

CPC ..... *F04D 25/0606* (2013.01); *F04D 19/00* (2013.01); *F04D 19/002* (2013.01); *F04D 29/053* (2013.01); *F04D 29/057* (2013.01)

(58) Field of Classification Search

CPC ..... F04D 19/002; F04D 19/00
USPC ..... 417/423.1, 423.15, 423.14, 424.1, 417/424.2

See application file for complete search history.

(56) References Cited

U.S. PATENT DOCUMENTS

| | | | | |
|---|---|---|---|---|
| 7,259,486 | B2 | 8/2007 | Yamamoto | |
| 8,282,367 | B2 * | 10/2012 | Ihle et al. | 417/423.8 |
| 8,419,386 | B2 * | 4/2013 | Horng | 417/353 |
| 2004/0234389 | A1 * | 11/2004 | Hatano et al. | 417/370 |
| 2009/0180901 | A1 | 7/2009 | Lee et al. | |
| 2010/0059056 | A1 * | 3/2010 | Sears et al. | 128/204.18 |
| 2010/0117468 | A1 | 5/2010 | Kurita | |
| 2011/0103981 | A1 * | 5/2011 | Horng et al. | 417/423.7 |
| 2011/0156520 | A1 * | 6/2011 | Mai et al. | 310/156.09 |
| 2011/0206521 | A1 * | 8/2011 | Horng et al. | 416/204 R |
| 2012/0039729 | A1 * | 2/2012 | Horng et al. | 417/410.1 |

FOREIGN PATENT DOCUMENTS

| | | | | |
|---|---|---|---|---|
| CN | 201265560 | Y | 7/2009 | |
| CN | 201284749 | Y | 8/2009 | |
| JP | 2001-107893 | A | 4/2001 | |
| JP | 2006-322451 | A | 11/2006 | |
| WO | WO 2008051534 | A2 * | 5/2008 | H02K 5/128 |

* cited by examiner

*Primary Examiner* — Charles Freay
*Assistant Examiner* — Christopher Bobish
(74) *Attorney, Agent, or Firm* — Keating & Bennett, LLP

(57) ABSTRACT

A motor arranged to rotate an impeller includes a rotor magnet fixed to a shaft, and a stator arranged opposite to the rotor magnet. The motor is arranged on an axially lower side of an impeller cup. The stator is fixed to an inner circumferential surface of a stator support portion. An opening-side end portion of the impeller cup is arranged opposite to an upper surface of the stator support portion. The upper surface of the stator support portion includes an expanded portion defined in a portion thereof which is opposed to the opening-side end portion of the impeller cup. The expanded portion is preferably located a greater distance from the opening-side end portion of the impeller cup than a distance between the opening-side end portion and a remaining portion of the upper surface of the stator support portion.

19 Claims, 10 Drawing Sheets

BLOWER FAN

BACKGROUND OF THE INVENTION

1. Field of the Invention

The present invention relates to a blower fan and more specifically to a blower fan preferably for use in cooling an electronic device or the like.

2. Description of the Related Art

As a motor used to drive a blower fan, an outer-rotor motor with a rotor arranged outside of a stator, has been primarily used with the view of facilitating an assembly process, reducing the number of parts, and so on. The outer-rotor motor is also favorable in terms of performance because the outer-rotor motor has a large moment of inertia and is capable of generating a large driving torque, and therefore has an excellent capability to rotate at a constant speed.

Meanwhile, electronic devices have been experiencing an increase in density of their components in recent years, and in accordance with this increase in density, the amount of heat generated by the electronic devices has been increasing. Accordingly, higher rotational speeds have been demanded of blower fans used to cool the electronic devices. However, because of the large moment of inertia, the outer-rotor motor tends to experience increased vibrations with increased rotational speed of the fan. The outer-rotor motor may therefore experience a problem in terms of strength.

An inner-rotor motor, in which a rotor is arranged inside of a stator, has a smaller moment of inertia than the outer-rotor motor. Therefore, use of the inner-rotor motor enables an increase in the rotational speed of the fan without a significant increase in vibrations.

For example, US 2009/0180901 describes a blower fan in which an inner-rotor motor is used. This blower fan includes a motor support portion that includes a bearing support portion arranged to support bearings and a stator support portion arranged to support a stator. These support portions are integral with each other.

In this blower fan, the bearing support portion, a rotor holder (including a rotor magnet), the stator, the stator support portion, an impeller cup, and blades are arranged in this order from a rotation axis toward a radial outside. In addition, radial gaps of specified widths are defined between the bearing support portion and the rotor holder, between the rotor holder and the stator, and between the stator support portion and the impeller cup.

On the other hand, in a typical blower fan of an outer-rotor type, a bearing support portion, a stator, a rotor holder (including a rotor magnet), an impeller cup, and blades are arranged in this order from a rotation axis toward a radial outside. In addition, the bearing support portion serves also as a stator support portion, and the impeller cup is press fitted to an outer circumference of the rotor holder. Therefore, a radial gap of a specified width is defined only between the stator and the rotor holder. A blower fan of an inner-rotor type therefore has a larger number of components arranged in a radial direction than the blower fan of the outer-rotor type, and therefore, a motor portion of the blower fan of the inner-rotor type has an increased radial dimension.

JP-A 2006-322451 describes a blower fan of the inner-rotor type (hereinafter referred to as a "known blower fan"). In the known blower fan, a rotor magnet is fixed to a shaft, and a motor portion is spaced axially away from an impeller and a bearing support portion. In the blower fan of the inner-rotor type having the above-described structure, the rotor magnet, a stator, and a stator support portion are arranged in this order from a rotation axis toward a radially outside portion of the blower fan. In addition, a radial gap of a specified width is defined only between the rotor magnet and the stator. Accordingly, a reduction in radial dimension of the motor portion is achieved.

Furthermore, in the known blower fan, the shaft is supported by the bearing support portion, and each of the impeller and the rotor magnet is joined to the shaft such that the impeller and the rotor magnet are arranged on an axially upper side and an axially lower side, respectively, of the bearing support portion. Therefore, correction of an unbalance that results from a displaced center of gravity of a rotating body including the impeller, the shaft, and the rotor magnet needs to be carried out in a situation in which the rotating body has been defined in one united body. In other words, correction of an unbalance of the rotating body needs to be carried out after the rotating body including the impeller, the shaft, and the rotor magnet is assembled. In view of a moment of inertia, it is desirable that the unbalance correction should be performed at a position near the center of gravity of the rotating body and as radially distant from a shaft center as possible. The amount of the correction can thus be minimized. Therefore, the unbalance correction is normally performed at an opening end portion of the impeller cup.

The impeller and the stator support portion, which is substantially cylindrical in shape, are arranged axially opposite each other. In order to reduce ventilation resistance of a wind tunnel portion, it is desirable that the outside diameter of the impeller cup and the outside diameter of the stator support portion be substantially equal to each other. Moreover, in order to reduce resistance against a wind blowing around an outer circumference of the stator support portion, it is desirable to reduce the distance between the impeller cup and the stator support portion.

However, the above-described desirable arrangements mean that the opening end portion of the impeller cup is arranged so close to the stator support portion that a sufficient space for the unbalance correction cannot be secured, making it difficult to perform the unbalance correction after assembling of the blower fan.

Furthermore, regarding the known blower fan, the rotating body including the impeller, the shaft, and the rotor magnet has a large axial dimension, in addition to having a small moment of inertia, and therefore tends to easily experience a displaced center of gravity due to assembling errors. Therefore, insufficient correction of the unbalance of the rotating body would lead to more marked occurrence of vibrations owing to the unbalance when the blower fan is caused to rotate at a high speed.

SUMMARY OF THE INVENTION

In view of the above-described circumstances, preferred embodiments of the present invention provide a blower fan that allows the unbalance correction to be performed easily and which does not cause significant vibrations even when being rotated at a high speed.

In order to overcome the above-described problems, a blower fan of an inner-rotor type in which a motor and an impeller are spaced axially away from each other according to a preferred embodiment of the present invention provide a structure in which an upper surface of a stator support portion which is opposed to an opening-side end portion of an impeller cup is provided with a portion (i.e., an expanded portion) arranged to provide a space for unbalance correction.

More specifically, a blower fan according to a preferred embodiment of the present invention includes a shaft, an impeller arranged to rotate about a rotation axis together with the shaft, and a motor arranged to rotate the impeller. The impeller preferably includes a substantially cylindrical impeller cup arranged to rotate together with the shaft, and a plurality of blades arranged on an outer circumferential surface of the impeller cup. The motor preferably includes a substantially annular rotor magnet fixed to the shaft, a stator arranged opposite to the rotor magnet, and a substantially cylindrical stator support portion. The motor is arranged on an axially lower side of the impeller cup, and the stator of the motor is fixed to an inner circumferential surface of the stator support portion. An opening-side end portion of the impeller cup is arranged opposite to an upper surface of the stator support portion. The upper surface of the stator support portion preferably includes an expanded portion defined at least in a portion thereof which is opposed to the opening-side end portion of the impeller cup, the expanded portion being located a greater distance from the opening-side end portion of the impeller cup than a distance between the opening-side end portion and a remaining portion of the upper surface of the stator support portion.

In the blower fan of the inner-rotor type in which the motor and the impeller are arranged axially away from each other according to a preferred embodiment of the present invention, the upper surface of the stator support portion which is opposed to the opening-side end portion of the impeller cup is provided with the expanded portion arranged to have an increased distance from the opening-side end portion of the impeller cup, so that the unbalance correction can be carried out easily. This makes it possible to realize a blower fan arranged to experience either no or only slight vibrations even when being rotated at a high speed.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

In the following description of preferred embodiments of the present invention, directions parallel to or substantially parallel to a rotation axis are referred to by the term "axial direction", "axial", or "axially", and directions radiating from the rotation axis are referred to by the term "radial direction", "radial", or "radially". Note that the present invention is not limited to the preferred embodiments described below. Also note that variations and modifications can be made appropriately as long as desired effects of the present invention are not impaired. Also note that the preferred embodiments described below may be combined with other preferred embodiments.

Figure 1:
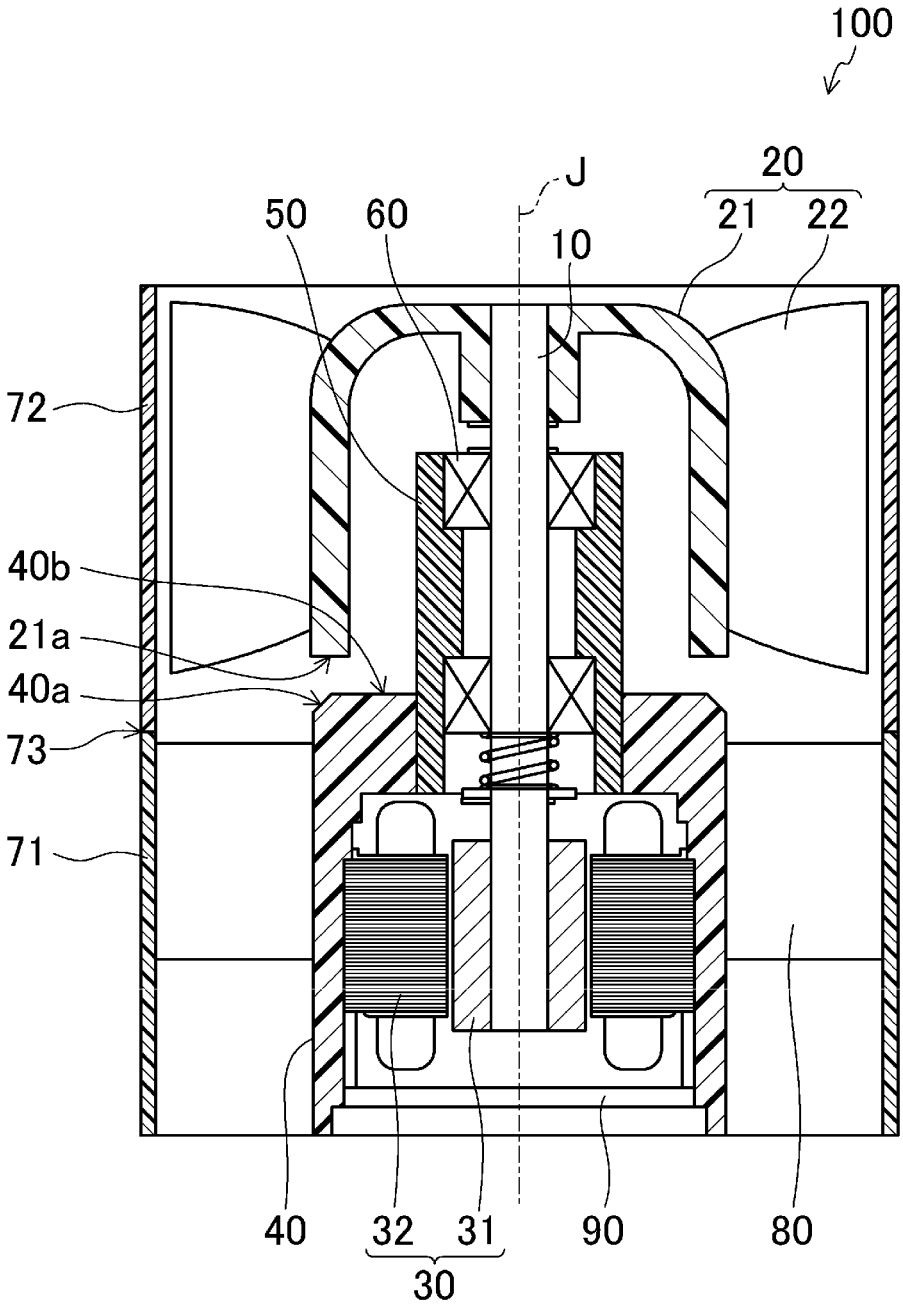
FIG. 1 is a schematic cross-sectional view illustrating the structure of a blower fan according to a first preferred embodiment of the present invention.

FIG. 1 is a schematic cross-sectional view illustrating the structure of a blower fan 100 according to a first preferred embodiment of the present invention. The blower fan 100 preferably is a so-called axial fan.

Referring to FIG. 1, the blower fan 100 according to the present preferred embodiment includes an impeller 20 and a motor 30. The impeller 20 is arranged to rotate about a rotation axis J together with a shaft 10. The motor 30 is arranged to rotate the impeller 20. The impeller 20 preferably includes an impeller cup 21 and a plurality of blades 22. The impeller cup 21 is substantially cylindrical and is arranged to rotate together with the shaft 10. The blades 22 are arranged on an outer circumferential surface of the impeller cup 21. Rotation of the impeller 20 causes air to be taken in from one axial side and discharged to an opposite axial side. Note that, for the sake of convenience, it is assumed herein that an inlet side and an outlet side in an axial direction are referred to as an "upper side" and a "lower side", respectively.

The motor 30 preferably includes a rotor magnet 31 and a stator 32. The rotor magnet 31 is substantially annular, and is fixed to the shaft 10. The stator 32 is arranged opposite to the rotor magnet 31. In addition, the motor 30 is arranged on an axially lower side of the impeller cup 21. The stator 32, which defines a portion of the motor 30, is fixed to an inner circumferential surface of a stator support portion 40, which is substantially cylindrical.

A bearing support portion 50 preferably is arranged radially inward of the impeller cup 21. The bearing support portion 50 is arranged to support the shaft 10 through bearings 60 such that the shaft 10 is rotatable. In addition, the bearing support portion 50 is joined to an inner circumferential surface of the stator support portion 40 at an axially lower end portion of the bearing support portion 50.

A housing that surrounds outer circumferences of the impeller 20 and the motor 30 is preferably axially divided into two portions, a first housing 71 and a second housing 72. That is, the housing is made up of the first and second housings 71 and 72. The stator support portion 40 is preferably arranged to be supported by the first housing 71 through a plurality of ribs 80, which are fixed to an outer circumferential surface of the stator support portion 40.

Referring to FIG. 1, in the present preferred embodiment, an opening-side end portion 21*a* of the impeller cup has a radially inside diameter that is preferably smaller than the diameter of a radially inner edge of an expanded portion 40*a* defined in an upper surface of the stator support portion 40. In addition, the outside diameter of the impeller cup 21 is arranged to be equal or substantially equal to the outside diameter of the stator support portion 40. Alternatively, the outside diameter of the impeller cup 21 may be arranged to be smaller or substantially smaller than the outside diameter of the stator support portion 40.

In either case, the opening-side end portion 21*a* of the impeller cup 21 is arranged to be opposite to an upper surface 40*b* of the stator support portion 40.

Figure 2:
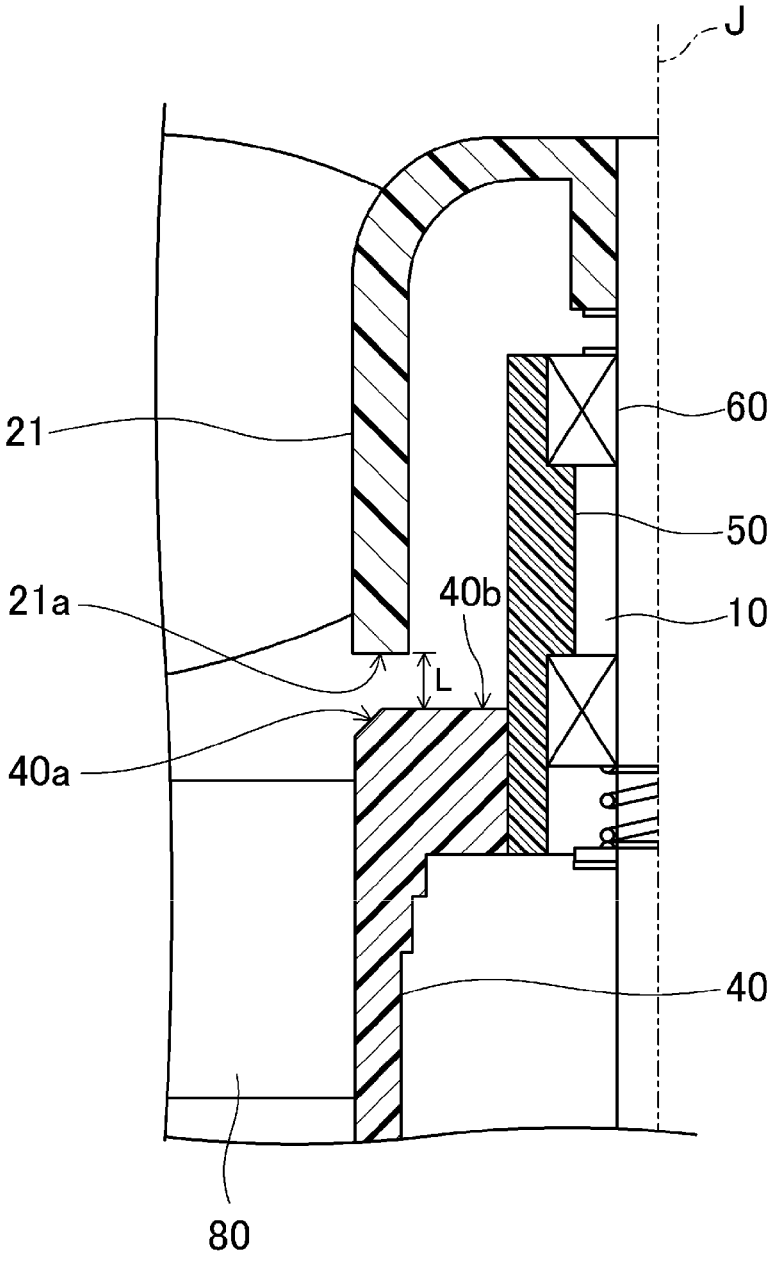
FIG. 2 is a half section view illustrating an opening-side end portion of an impeller cup and an upper surface of a stator support portion of the blower fan illustrated in FIG. 1 and their vicinities in an enlarged form.

FIG. 2 is a half section view illustrating the opening-side end portion 21*a* of the impeller cup 21 and the upper surface 40*b* of the stator support portion 40 of the blower fan 100 illustrated in FIG. 1 and their vicinities in an enlarged form.

Referring to FIG. 2, the upper surface 40*b* of the stator support portion 40 includes the expanded portion 40*a* defined in a portion thereof which is axially opposed to the opening-side end portion 21*a* of the impeller cup 21. The expanded portion 40*a* preferably is located a greater distance from the opening-side end portion 21*a* of the impeller cup 21 than a distance L between the opening-side end portion 21*a* and a remaining portion of the upper surface 40*b* of the stator support portion 40.

When the distance L is small (for example, about 2 mm or less), it is difficult to perform unbalance correction on the opening-side end portion 21*a* of the impeller cup 21. In the present preferred embodiment, however, providing the expanded portion 40*a*, which has an increased distance from the opening-side end portion 21*a*, in the upper surface 40*b* of the stator support portion 40 contributes to securing a sufficient space for the unbalance correction. This makes it easier to perform the unbalance correction, and allows the blower fan 100 to experience either no or only slight vibrations even when the blower fan 100 is caused to rotate at a high speed.

Here, regarding the expanded portion 40*a* according to a preferred embodiment of the present invention, it is enough that the expanded portion 40*a* is defined in at least a portion of the upper surface of the stator support portion which is opposed to the opening-side end portion 21*a* of the impeller cup 21. Note that it is not necessary that the expanded portion 40*a* be defined in an entire portion of the upper surface of the stator support portion which is opposed to the opening-side end portion 21*a* of the impeller cup 21. Also note that the expanded portion 40*a* may be arranged to extend into another portion of the upper surface of the stator support portion than the portion thereof that is opposed to the opening-side end portion 21*a* of the impeller cup 21. Also note that no particular limitation is imposed on the shape of the expanded portion 40*a*. For example, the expanded portion 40*a* may be arranged to assume a tapered shape, a step-like shape, or other suitable shapes.

FIGS. 3A, 3B, 3C, and 3D are each a partial cross-sectional view illustrating an example shape of the expanded portion 40*a*.

Figure 3A:
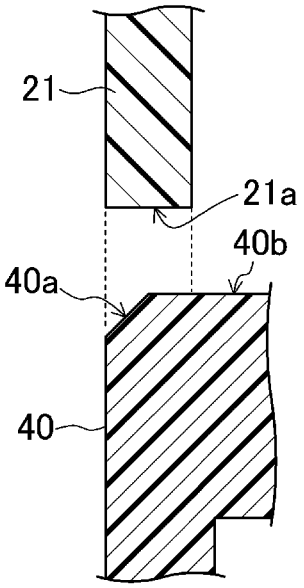
FIGS. 3A, 3B, 3C, and 3D are each a partial cross-sectional view illustrating an example shape of an expanded portion according to the first preferred embodiment of the present invention.

An expanded portion 40*a* illustrated in FIG. 3A is arranged to define a tapered portion which is inclined axially downward in a radially outward direction. In FIG. 3A, the tapered portion is defined in a portion of the portion of the upper surface 40*b* of the stator support portion 40 which is opposed to the opening-side end portion 21*a* of the impeller cup 21. Note, however, that the tapered portion may be defined throughout the entire portion of the upper surface 40*b* of the stator support portion 40 which is opposed to the opening-side end portion 21*a* of the impeller cup 21. Also note that no particular limitation is imposed on an angle of inclination of the tapered portion, and that the tapered portion may be arranged to undergo a change in the angle of inclination at some point so that different portions of the tapered portion have different angles of inclination.

Figure 3B:
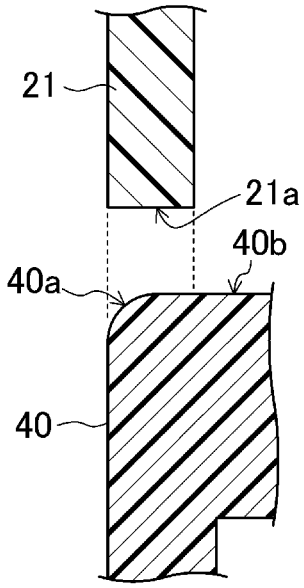

An expanded portion 40*a* illustrated in FIG. 3B is arranged to define a curved tapered portion. In FIG. 3B, the expanded portion 40*a* is arranged to be convexly rounded. Note, however, that the expanded portion 40*a* may alternatively be arranged to be concavely rounded.

Figure 3C:
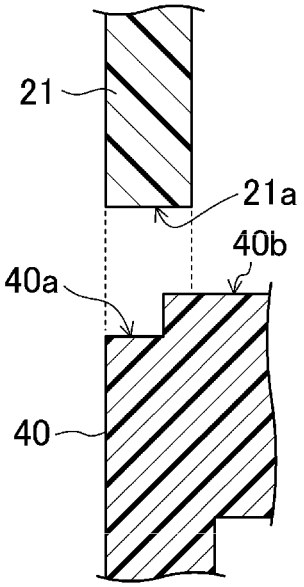

An expanded portion 40*a* illustrated in FIG. 3C is arranged to define a step portion. Note that no particular limitation is imposed on the size of a step of the step portion. Also note that the step portion may be arranged to include more than one step.

Figure 3D:
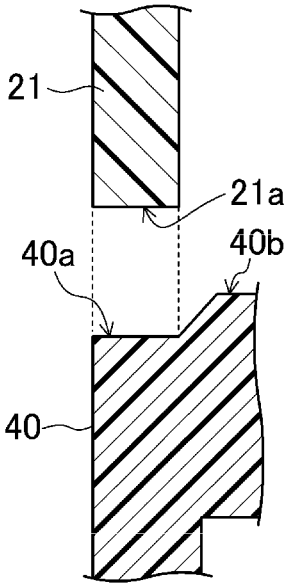

An expanded portion 40*a* illustrated in FIG. 3D is arranged to define a flat portion in the portion of the upper surface 40*b* of the stator support portion 40 which is opposed to the opening-side end portion 21*a* of the impeller cup 21. The distance between the opening-side end portion 21*a* of the impeller cup 21 and the flat portion is preferably arranged to be greater than or substantially greater than the distance between the opening-side end portion 21*a* of the impeller cup 21 and a remaining portion of the upper surface 40*b* of the stator support portion 40.

Figure 4A:
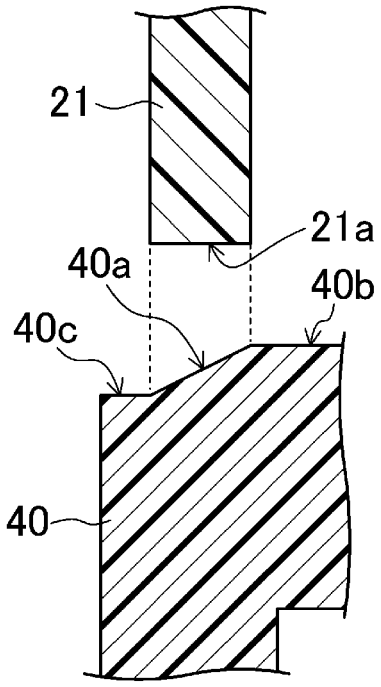
FIGS. 4A and 4B are each a partial cross-sectional view illustrating an example shape of the expanded portion according to the first preferred embodiment of the present invention.
Figure 4B:
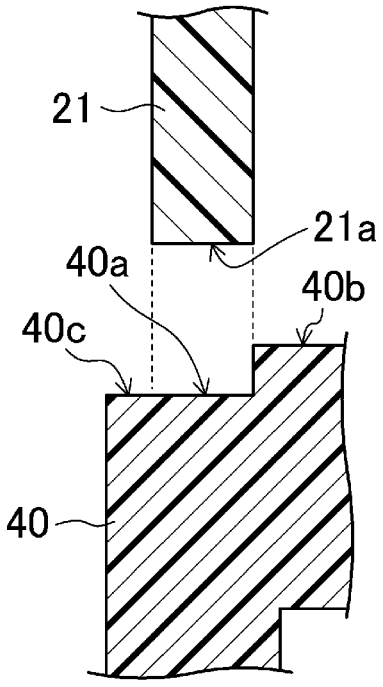

Note that the outside diameter of the impeller cup 21 may be arranged to be preferably smaller than the outside diameter of the stator support portion 40 in other preferred embodiments of the present invention. FIGS. 4A and 4B are each a partial cross-sectional view illustrating an example shape of the expanded portion 40*a* in that case.

An expanded portion 40*a* illustrated in FIG. 4A is arranged to define a tapered portion in the portion of the upper surface 40*b* of the stator support portion 40 which is opposed to the opening-side end portion 21*a* of the impeller cup 21. A portion of the upper surface 40*b* of the stator support portion 40 which is located radially outward of the expanded portion 40*a* is arranged to define a flat portion 40*c* continuously provided with a lower end of the tapered portion. A sufficient space for the unbalance correction is thereby secured axially below the opening-side end portion 21*a* of the impeller cup 21.

An expanded portion 40*a* illustrated in FIG. 4B is arranged to define a step portion in the portion of the upper surface 40*b* of the stator support portion 40 which is opposed to the opening-side end portion 21*a* of the impeller cup 21. A portion of the upper surface 40*b* of the stator support portion 40 which is located radially outward of the expanded portion 40*a* is arranged to define a flat portion 40*c* continuously provided with the step portion.

Next, referring to FIGS. 5, 6, 7, and 8, an example of a preferred method for assembling the blower fan 100 according to the present preferred embodiment will now be described below.

Figure 5:
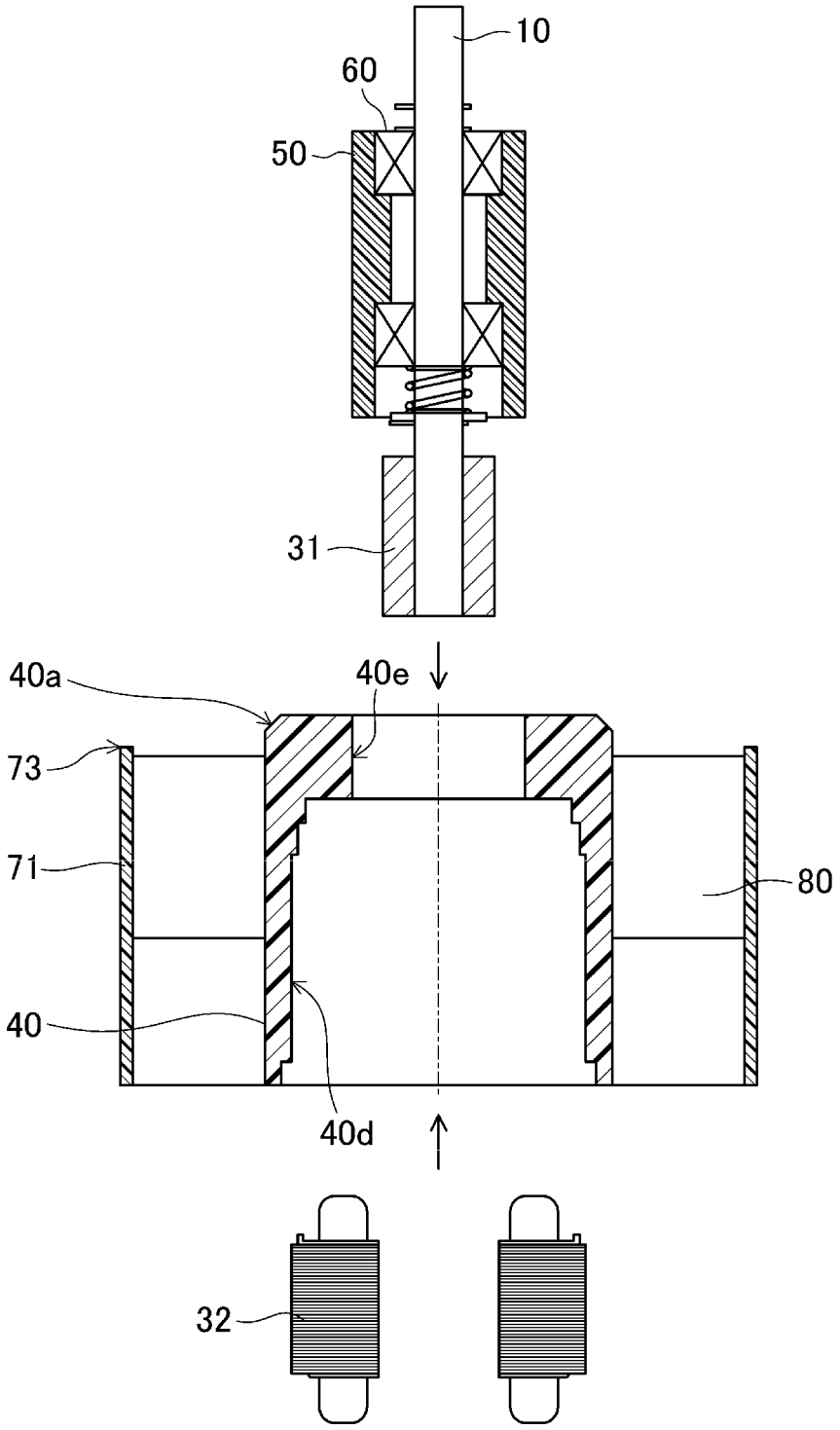
FIG. 5 is a cross-sectional view for explaining an exemplary method of assembling the blower fan according to the first preferred embodiment of the present invention.

Referring to FIG. 5, the stator support portion 40, which is substantially cylindrical, is prepared. According to the present preferred embodiment, the stator support portion 40 is supported by the first housing 71 through the ribs 80 fixed to the outer circumferential surface of the stator support portion 40, and the stator support portion 40, the ribs 80, and the first housing 71 are preferably integral with one another to define a single monolithic member.

Then, the stator 32 is press fitted to an inner circumferential surface 40*d* of the stator support portion 40 from axially below the stator support portion 40, and the stator is fixed to the inner circumferential surface 40*d* of the stator support portion 40.

In addition, the bearing support portion 50 with the shaft 10, the rotor magnet 31, and the bearings 60 assembled together is press fitted to an inner circumferential surface 40*e* of the stator support portion 40 from axially above the stator support portion 40, and the bearing support portion 50 is fixed to the inner circumferential surface 40*e* of the stator support portion 40.

Figure 6:
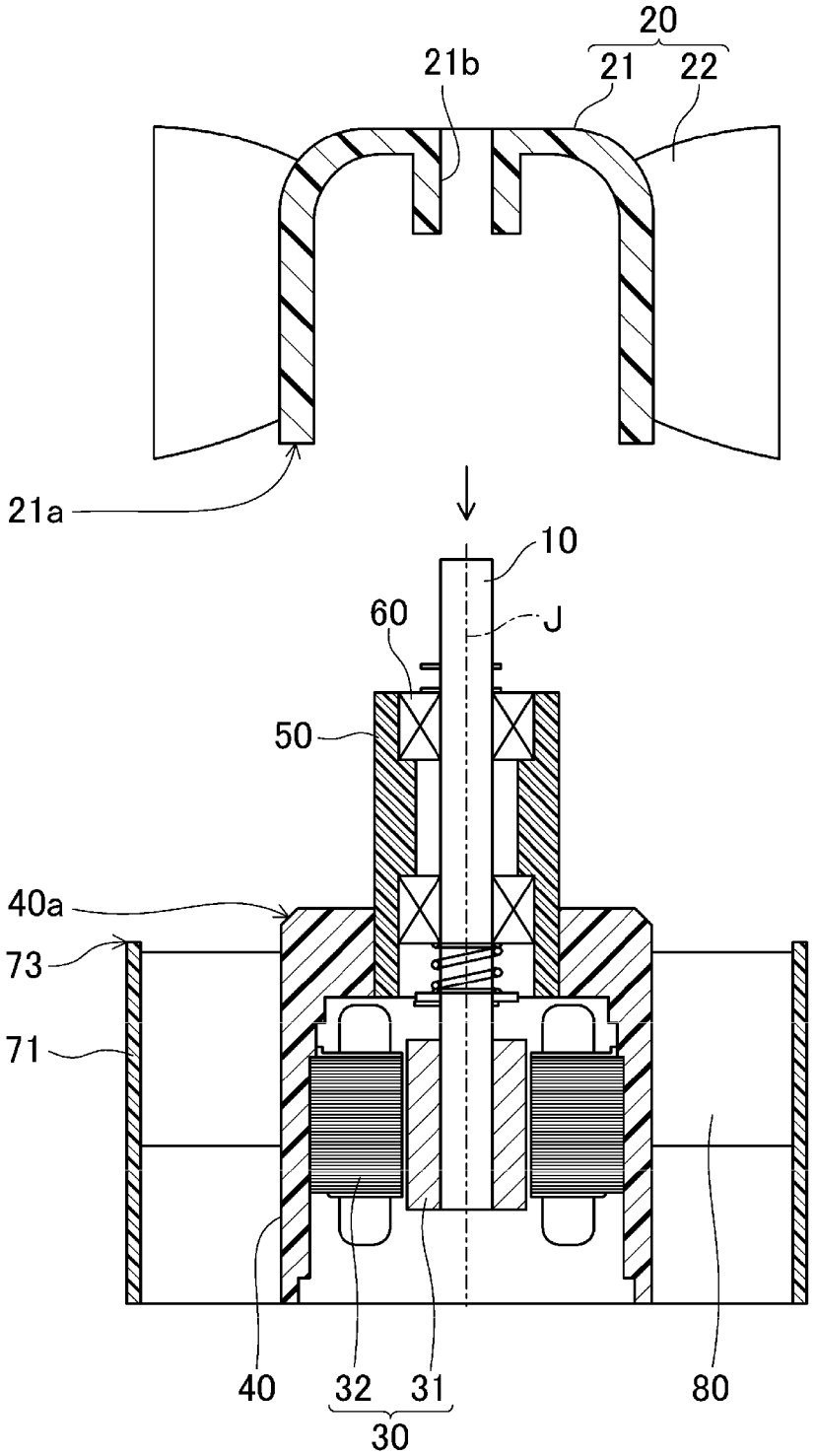
FIG. 6 is a cross-sectional view for explaining the exemplary method of assembling the blower fan according to the first preferred embodiment of the present invention.

Next, referring to FIG. 6, the impeller 20, which includes the impeller cup 21 and the blades 22 arranged on the outer circumferential surface of the impeller cup 21, is moved from axially above the bearing support portion 50 toward the bearing support portion 50, and a boss portion 21*b* defined in a central portion of the impeller cup 21 is press fitted to the shaft 10, so that the impeller 20 is fixed to the shaft 10.

Figure 7:
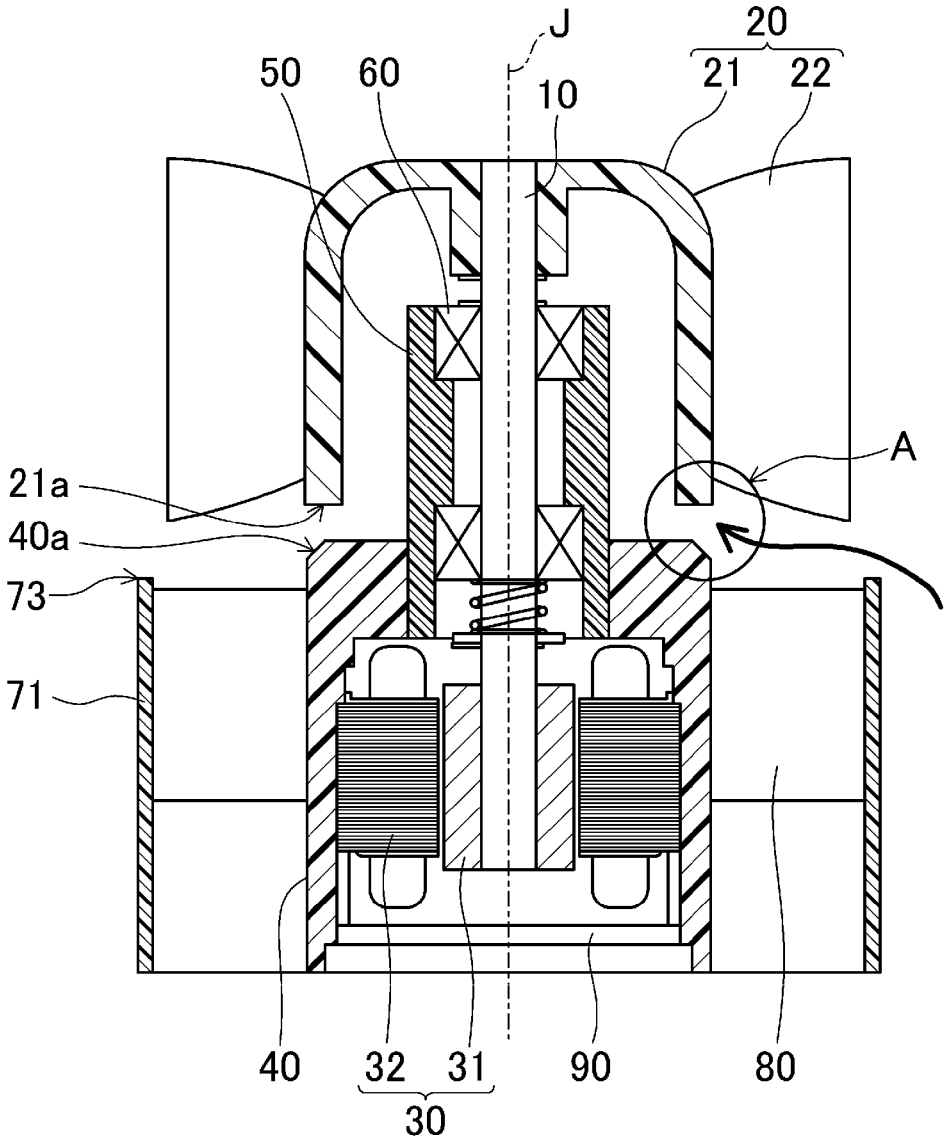
FIG. 7 is a cross-sectional view for explaining the exemplary method of assembling the blower fan according to the first preferred embodiment of the present invention.

FIG. 7 is a cross-sectional view of the blower fan 100 assembled in the above-described procedure. When the blower fan 100 is in this assembled state, a rotating body including the impeller 20, the shaft 10, and the rotor magnet 31 is supported by the stator support portion 40 and the first housing 71.

In conventional blower fans which are assembled by inserting a rotating body including an impeller, a rotor magnet, and a shaft united with one another into a bearing, it is only possible to correct an unbalance of the rotating body before the blower fan is assembled. In contrast, the blower fan 100 according to the present preferred embodiment in which the motor and the impeller are arranged axially away from each other makes it possible to correct an unbalance of the rotating body after the blower fan 100 is assembled.

At this time, the opening-side end portion 21*a* of the impeller cup 21 is arranged opposite to the upper surface of the stator support portion 40, and the upper surface of the stator support portion 40 includes the expanded portion 40*a* defined in the portion thereof which is opposed to the opening-side end portion 21*a* of the impeller cup 21. A sufficient space A for the unbalance correction is thereby secured axially below the opening-side end portion 21*a* of the impeller cup 21. Therefore, when the blower fan 100 is in this assembled state, it is easy to correct the unbalance of the rotating body including the impeller 20, the shaft 10, and the rotor magnet 31.

Moreover, when the blower fan 100 is in the assembled state, the second housing 72 has not yet been joined to the first housing 71, and the space A is therefore open to the outside of the blower fan 100 on a radial outside thereof. Therefore, it is easy to carry out correction of the unbalance of the rotating body from a direction indicated by an arrow shown in FIG. 7, for example.

The opening-side end portion 21*a* of the impeller cup 21 defines a balance adjustment portion where a displaced center of gravity of the rotating body including at least the impeller 20, the shaft 10, and the rotor magnet 31 is adjusted. A method of balance adjustment in accordance with the preferred embodiments of the present invention is not limited in any particular manner. For example, the balance adjustment may be accomplished by attaching a weight of a specified size to the opening-side end portion 21*a* of the impeller cup 21. Moreover, a recessed portion, a tapered portion, or the like where the weight is to be attached may be previously defined in the opening-side end portion 21*a* of the impeller cup 21.

A division position 73 at which the first and second housings 71 and 72 are divided from each other is preferably arranged at a level lower than at least that of the opening-side end portion 21*a* of the impeller cup 21. Furthermore, in the case where the expanded portion 40*a* is defined by the tapered portion, the division position 73 at which the first and second housings 71 and 72 are divided from each other is more preferably arranged at a level lower than that of an axially lower end portion of the tapered portion. Furthermore, the ribs 80 are preferably fixed to the outer circumferential surface of the stator support portion 40 on an axially lower side of an axially lower end portion of the expanded portion 40*a*.

Figure 8:
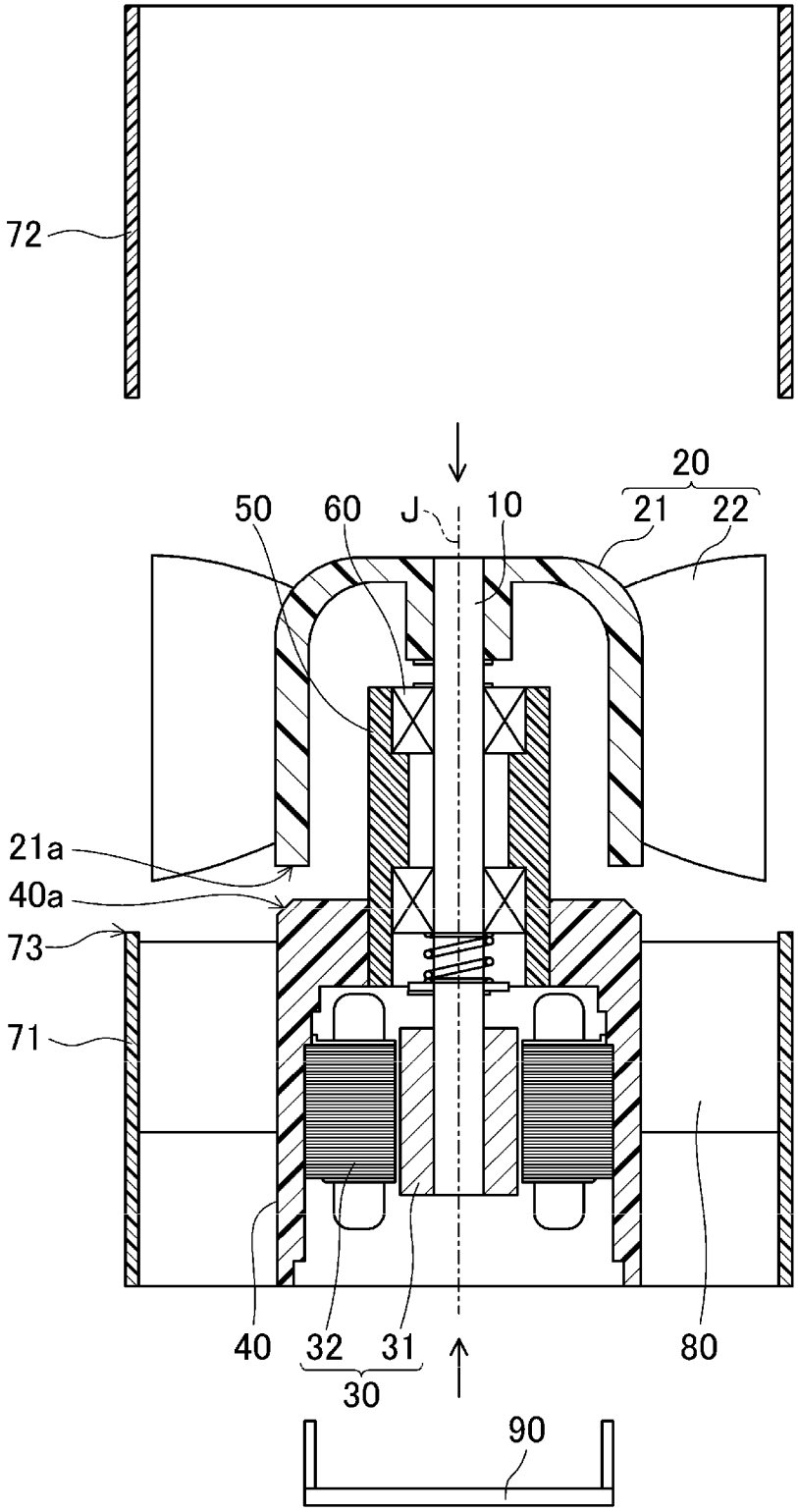
FIG. 8 is a cross-sectional view for explaining the exemplary method of assembling the blower fan according to the first preferred embodiment of the present invention.

Referring to FIG. 8, after the unbalance correction is carried out, finally, the second housing 72 is brought closer to the first housing 71 from axially above, and joined to the first housing 71. In addition, a circuit board 90, which is designed to control the driving of the motor, is inserted into the stator support portion 40 from axially below, and fixed to the stator support portion 40. The blower fan 100 illustrated in FIG. 1 is thereby completed.

Note that no particular limitation is imposed on a material used to make the stator support portion 40 according to the present preferred embodiment. For example, the stator support portion 40 may be made of a resin, and in this case, the stator support portion 40, the ribs 80, and the first housing 71 may all be made of the resin and defined integrally with one another. Also note that an inner circumferential portion of the stator support portion 40 at which the stator 32 is fixed to the stator support portion 40 may also be made of a metallic material.

In the foregoing description of the first preferred embodiment of the present invention, a description has been given of an example of the correction of the unbalance of the rotating body including the impeller 20, the shaft 10, and the rotor magnet 31 of the blower fan 100 of an inner-rotor type in which the motor 30 and the impeller 20 are arranged axially away from each other.

However, the above-described technique of securing a sufficient space to facilitate the correction of the unbalance of the rotating body including the impeller 20, the shaft 10, and the rotor magnet 31 is also applicable to blower fans having different structures.

A second preferred embodiment of the present invention will now be described below. A blower fan 110 according to the second preferred embodiment of the present invention is different in structure from the blower fan 100 according to the first preferred embodiment of the present invention.

Figure 9:
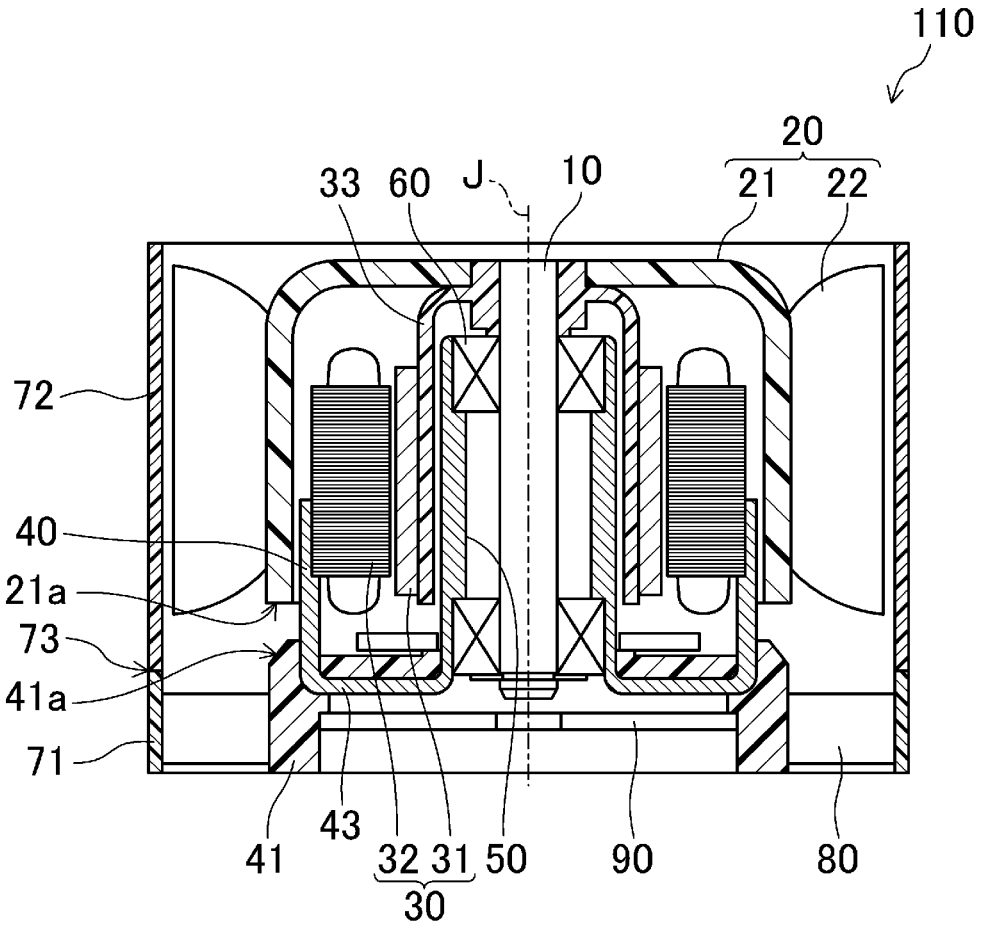
FIG. 9 is a cross-sectional view illustrating the structure of a blower fan according to a second preferred embodiment of the present invention.

FIG. 9 is a cross-sectional view illustrating the structure of the blower fan 110 according to the second preferred embodiment of the present invention.

The blower fan 110 according to the present preferred embodiment is a blower fan of the inner-rotor type as with the blower fan 100 according to the first preferred embodiment, but is different from the blower fan 100 according to the first preferred embodiment in that a motor 30 and bearings 60 are arranged radially inward of an impeller cup 21.

Referring to FIG. 9, the blower fan 110 according to the present preferred embodiment includes an impeller 20 and the motor 30. The impeller 20 is arranged to rotate about a rotation axis J together with a shaft 10. The motor 30 is arranged to rotate the impeller 20. The impeller 20 preferably includes the impeller cup 21 and a plurality of blades 22. The impeller cup 21 is preferably substantially cylindrical, and is fixed to the shaft 10. The blades 22 are arranged on an outer circumferential surface of the impeller cup 21.

The motor 30 is arranged radially inward of the impeller cup 21. In addition, a stator 32, which defines a portion of the motor 30, is fixed to an inner circumferential surface of a stator support portion 40, which is substantially cylindrical.

A bearing support portion 50 and a rotor magnet 31 are arranged radially inward of the stator 32. The bearing support portion 50 is arranged to support the shaft 10 through the bearings 60 such that the shaft 10 is rotatable. The rotor magnet 31 is arranged opposite to the stator 32, and is arranged to rotate together with the shaft 10. Here, the rotor magnet 31 is preferably fixed to an outer circumferential surface of a rotor holder 33, which is substantially cylindrical and is coupled to the impeller cup 21.

In addition, the bearing support portion 50 is joined to the stator support portion 40 through a joining portion 43. In this case, the stator support portion 40, the joining portion 43, and the bearing support portion 50 may all be made of a metallic material and may be integral with one another to define a single monolithic member, for example.

The motor 30 according to the present preferred embodiment preferably includes a base portion 41 arranged to extend radially outward from an outer circumferential surface of the stator support portion 40. An opening-side end portion 21*a* of the impeller cup 21 is arranged opposite to an axially upper end portion of the base portion 41.

In addition, a housing that encloses outer circumferences of the impeller 20 and the motor 30 is axially divided into two portions, a first housing 71 and a second housing 72. That is, the housing is made up of the first and second housings 71 and 72. The stator support portion 40 is preferably supported by the first housing 71 through the base portion 41 and ribs 80.

The axially upper end portion of the base portion 41 includes an expanded portion 41*a* defined at least in a portion thereof which is opposed to the opening-side end portion 21*a* of the impeller cup 21. The expanded portion 41*a* is preferably located a greater distance from the opening-side end portion 21*a* of the impeller cup 21 than a distance between the opening-side end portion 21*a* and a remaining portion of the axially upper end portion of the base portion 41.

A sufficient space for unbalance correction is provided by, as described above, defining the expanded portion 41*a*, which is arranged to have an increased distance from the opening-side end portion 21*a* of the impeller cup 21, in the axially upper end portion of the base portion 41. This space makes it easier to carry out the unbalance correction, and allows the blower fan 110 to experience either no or only slight vibrations even when the blower fan 110 is caused to rotate at a high speed.

Also in the present preferred embodiment, it is preferable that correction of an unbalance of a rotating body including the impeller 20, the shaft 10, and the rotor magnet 31 should be carried out before the second housing 72 is joined to the first housing 71. The correction of the unbalance of the rotating body can then be carried out easily because the space secured below the opening-side end portion 21*a* of the impeller cup 21 is open on a radial outside thereof. Note that, in this case, a division position 73 at which the first and second housings 71 and 72 are divided from each other is preferably arranged at a level lower than that of the opening-side end portion 21*a* of the impeller cup 21.

In the present preferred embodiment, no particular limitation is imposed on the shape of the expanded portion 41*a*. For example, the expanded portion 41*a* may be arranged to define a tapered portion which is inclined axially downward in a radially outward direction. This tapered portion may include an outwardly rounded portion. Alternatively, the expanded portion 41*a* may be arranged to define a step portion.

In the present preferred embodiment, the outside diameter of the impeller cup 21 may preferably be arranged to be either equal or substantially equal to the outside diameter of the base portion 41, or smaller than the outside diameter of the base portion 41.

Note that, in the case where the bearing support portion 50, the joining portion 43, and the stator support portion 40 are all made of the metallic material and preferably integral with one another to define a single monolithic element in the present preferred embodiment, it may be so arranged that the base portion 41 is preferably made of, for example, a resin, and that the stator support portion 40, the joining portion 43, and the bearing support portion 50 are coupled to the base portion 41 by, for example, an insert molding process. Also note that, alternatively, the stator support portion 40 and the base portion 41 may both be made of, for example, a resin and integral with each other to define a single monolithic member.

Figure 10:
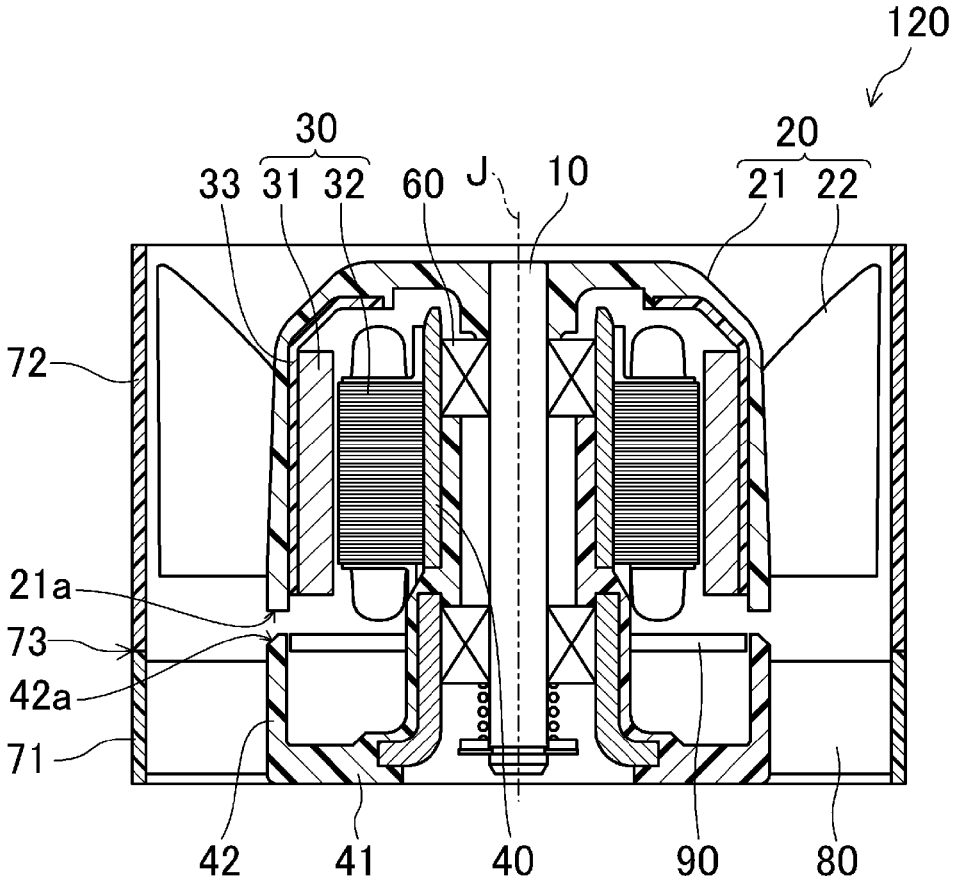
FIG. 10 is a cross-sectional view illustrating the structure of a blower fan according to a third preferred embodiment of the present invention.

A third preferred embodiment of the present invention will now be described below. A blower fan 120 according to the third preferred embodiment is different in structure from the blower fan 100 according to the first preferred embodiment of the present invention. FIG. 10 is a cross-sectional view illustrating the structure of the blower fan 120 according to the third preferred embodiment of the present invention.

The blower fan 120 according to the present preferred embodiment is different from the blower fan 100 according to the first preferred embodiment in that the blower fan 120 is a blower fan of an outer-rotor type, and that a motor 30 and bearings 60 thereof are arranged radially inward of an impeller cup 21 thereof.

Referring to FIG. 10, the blower fan 120 according to the present preferred embodiment includes an impeller 20 and the motor 30. The impeller 20 is arranged to rotate about a rotation axis J together with a shaft 10. The motor 30 is arranged to rotate the impeller 20. The impeller 20 preferably includes the impeller cup 21 and a plurality of blades 22. The impeller cup 21 is substantially cylindrical, and is fixed to the shaft 10. The blades 22 are arranged on an outer circumferential surface of the impeller cup 21.

The motor 30 is arranged radially inward of the impeller cup 21. A stator 32, which defines a portion of the motor 30, is fixed to an outer circumferential surface of a stator support portion 40, which is substantially cylindrical.

A rotor magnet 31, which is arranged to rotate together with the shaft 10, is preferably arranged radially outward of the stator 32 and opposite to the stator 32, and is fixed to an inner circumferential surface of the impeller cup 21. Here, the rotor magnet 31 is fixed to an inner circumferential surface of a substantially cylindrical rotor holder 33, which is preferably press fitted to the inner circumferential surface of the impeller cup 21. In addition, an inner circumferential surface of the stator support portion 40 is arranged to rotatably support the shaft 10 through the bearings 60. That is, the stator support portion 40 is preferably arranged to also serve as a bearing support portion in the present preferred embodiment.

The motor 30 according to the present preferred embodiment preferably includes a base portion 41 arranged to spread radially outward from an outer circumferential surface of the stator support portion 40. The motor 30 preferably further includes a circumferential wall 42 arranged to extend axially upward from a radially outer end portion of the base portion 41. An opening-side end portion 21*a* of the impeller cup 21 is arranged opposite to an axial end portion of the circumferential wall 42.

A housing that encloses outer circumferences of the impeller 20 and the motor 30 is axially divided into two portions, a first housing 71 and a second housing 72. That is, the housing is made up of the first and second housings 71 and 72. The stator support portion 40 is supported by the first housing 71 through the base portion 41, the circumferential wall 42, and ribs 80.

In addition, the axial end portion of the circumferential wall 42 preferably includes an expanded portion 42*a* defined in a portion thereof which is opposed to the opening-side end portion 21*a* of the impeller cup 21. The expanded portion 42*a* preferably is located a greater distance from the opening-side end portion 21*a* of the impeller cup 21 than a distance between the opening-side end portion 21*a* and a remaining portion of the axial end portion of the circumferential wall 42.

A sufficient space for unbalance correction is secured by, as described above, defining the expanded portion 42*a*, which is arranged to have an increased distance from the opening-side end portion 21*a* of the impeller cup 21, in the axial end portion of the circumferential wall 42. This space makes it easier to carry out the unbalance correction, and allows the blower fan 120 to experience no or only slight vibrations even when the blower fan 120 is caused to rotate at a high speed.

Also in the present preferred embodiment, it is preferable that correction of an unbalance of a rotating body including the impeller 20, the shaft 10, and the rotor magnet 31 should be carried out before the second housing 72 is joined to the first housing 71. The correction of the unbalance of the rotating body can then be carried out easily because the space secured below the opening-side end portion 21*a* of the impeller cup 21 is open on a radial outside thereof. Note that, in this case, a division position 73 at which the first and second housings 71 and 72 are divided from each other is preferably arranged at a level axially lower than that of the opening-side end portion 21*a* of the impeller cup 21.

In the present preferred embodiment, no particular limitation is imposed on the shape of the expanded portion 42*a*. For example, the expanded portion 42*a* may be arranged to define a tapered portion which is inclined axially downward in a radially outward direction. This tapered portion may include a convexly or concavely rounded portion. Alternatively, the expanded portion 42*a* may be arranged to define a step portion.

In the present preferred embodiment, the outside diameter of the impeller cup 21 may be arranged to be either equal or substantially equal to the outside diameter of the circumferential wall 42, or smaller than the outside diameter of the circumferential wall 42.

Note that, in the case where the stator support portion 40 is made of a metallic material in the present preferred embodiment, it may be so arranged that the base portion 41 and the circumferential wall 42 are both made of a resin, and that the stator support portion 40 is coupled to the base portion 41 and the circumferential wall 42 by, for example, an insert molding process. Also note that, alternatively, the stator support portion 40, the base portion 41, and the circumferential wall 42 may all be made of, for example, a resin and defined integrally with one another as a single monolithic member.

In each of the above-described preferred embodiments, no particular limitation is imposed on the distance between the opening-side end portion 21*a* of the impeller cup 21 and the upper surface of the stator support portion 40, the axially upper end portion of the base portion 41, or the axial end portion of the circumferential wall 42. Note, however, that with the view of reducing resistance against a wind blowing around an outer circumference of the stator support portion 40, the base portion 41, or the circumferential wall 42, it is preferable that the aforementioned distance should be limited to, for example, about 4 mm or less (more preferably, about 2 mm or less).

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A blower fan comprising:

a shaft;

an impeller arranged to rotate about a rotation axis together with the shaft; and a motor arranged to rotate the impeller; and a housing configured to enclose outer circumferences of the impeller and the motor, the housing including a first housing and a second housing divided from each other in an axial direction to define a cylindrical chamber, each of the first housing and the second housing including radially inner surfaces which have substantially constant slopes defining the cylindrical chamber; wherein the impeller includes a substantially cylindrical impeller cup arranged to rotate together with the shaft, and a plurality of blades arranged on an outer circumferential surface of the impeller cup;

the motor includes a substantially annular rotor magnet fixed to the shaft, a stator arranged opposite to the rotor magnet, and a substantially cylindrical stator support portion;

the motor is arranged on an axially lower side of the impeller cup, and the stator of the motor is fixed to an inner circumferential surface of the stator support portion;

an opening-side end portion of the impeller cup is arranged opposite to an upper surface of the stator support portion;

the upper surface of the stator support portion includes an expanded portion defined at least in a portion thereof which is axially opposed to the opening-side end portion of the impeller cup, the expanded portion being located a greater distance from the opening-side end portion of the impeller cup than an axial distance between the opening-side end portion and a remaining portion of the upper surface of the stator support portion;

the first housing is configured to support the stator support portion and a division position at which the first and second housings are divided from each other is arranged at an axial level lower than at least that of the opening-side end portion of the impeller cup; and the expanded portion of the upper surface of the stator support portion is positioned at a level axially above the stator.

2. The blower fan according to claim 1, wherein the expanded portion is arranged to define a tapered portion which is inclined axially downward in a radially outward direction.

3. The blower fan according to claim 2, wherein the tapered portion includes a convexly rounded portion.

4. The blower fan according to claim 1, wherein the expanded portion is arranged to define a step portion.

5. The blower fan according to claim 2, wherein the division position at which the first and second housings are divided from each other is arranged at an axial level lower than that of an axially lower end portion of the tapered portion.

6. The blower fan according to claim 1, wherein an outside diameter of the impeller cup is equal or substantially equal to an outside diameter of the stator support portion, or smaller than the outside diameter of the stator support portion.

7. The blower fan according to claim 1, further comprising a bearing support portion arranged radially inward of the impeller cup to rotatably support the shaft through a bearing.

8. The blower fan according to claim 7, wherein the bearing support portion is joined to the upper surface of the stator support portion at an axially lower end portion of the bearing support portion.

9. The blower fan according to claim 1, further comprising a plurality of ribs fixed to an outer circumferential surface of the stator support portion, wherein the first housing is arranged to support the stator support portion through the ribs.

10. The blower fan according to claim 9, wherein the ribs are fixed to the outer circumferential surface of the stator support portion on an axially lower side of an axially lower end portion of the expanded portion.

11. The blower fan according to claim 1, wherein the distance between the remaining portion of the upper surface of the stator support portion and the opening-side end portion of the impeller cup is 4 mm or less.

12. The blower fan according to claim 1, wherein the opening-side end portion of the impeller cup is arranged to define a balance adjustment portion where a displaced center of gravity of a rotating body including at least the impeller, the shaft, and the rotor magnet is adjusted.

13. A blower fan comprising:

a shaft;

an impeller arranged to rotate about a rotation axis together with the shaft; and a motor arranged to rotate the impeller; and a housing configured to enclose outer circumferences of the impeller and the motor, the housing including a first housing and a second housing divided from each other in an axial direction to define a cylindrical chamber with a substantially constant radial thickness along its entire length; wherein the impeller includes a substantially cylindrical impeller cup arranged to rotate together with the shaft, and a plurality of blades arranged on an outer circumferential surface of the impeller cup;

the motor includes a substantially annular rotor magnet fixed to the shaft, a stator arranged opposite to the rotor magnet, and a substantially cylindrical stator support portion;

the motor is arranged on an axially lower side of the impeller cup, and the stator of the motor is fixed to an inner circumferential surface of the stator support portion;

an opening-side end portion of the impeller cup is arranged opposite to an upper surface of the stator support portion;

the upper surface of the stator support portion includes an expanded portion defined at least in a portion thereof which is axially opposed to the opening-side end portion of the impeller cup, the expanded portion being located a greater distance from the opening-side end portion of the impeller cup than an axial distance between the opening-side end portion and a remaining portion of the upper surface of the stator support portion;

the first housing is configured to support the stator support portion;

a division position at which the first and second housings are divided from each other is arranged at an axial level lower than at least that of the opening-side end portion of the impeller cup; and the expanded portion of the upper surface of the stator support portion is positioned at a level axially above the stator.

14. The blower fan according to claim 13, wherein the expanded portion is arranged to define a tapered portion which is inclined axially downward in a radially outward direction.

15. The blower fan according to claim 13, wherein the division position at which the first and second housings are divided from each other is arranged at an axial level lower than that of an axially lower end portion of the tapered portion.

16. The blower fan according to claim 13, wherein an outside diameter of the impeller cup is equal or substantially equal to an outside diameter of the stator support portion, or smaller than the outside diameter of the stator support portion.

17. The blower fan according to claim 13, further comprising a plurality of ribs fixed to an outer circumferential surface of the stator support portion, wherein the first housing is arranged to support the stator support portion through the ribs.

18. The blower fan according to claim 17, wherein the ribs are fixed to the outer circumferential surface of the stator support portion on an axially lower side of an axially lower end portion of the expanded portion.

19. The blower fan according to claim 13, wherein the opening-side end portion of the impeller cup is arranged to define a balance adjustment portion where a displaced center of gravity of a rotating body including at least the impeller, the shaft, and the rotor magnet is adjusted.

* * * * *